US007594842B2

(12) United States Patent
Lee et al.

(10) Patent No.: US 7,594,842 B2
(45) Date of Patent: Sep. 29, 2009

(54) CASSETTE ASSEMBLY FOR MANUFACTURING FLUORESCENT LAMPS

(75) Inventors: Young-Chul Lee, Yongin-si (KR); Dong-Gil Kim, Seoul (KR); Sung-Jung Kim, Seoul (KR)

(73) Assignee: DMS Co., Ltd. (KR)

( * ) Notice: Subject to any disclaimer, the term of this patent is extended or adjusted under 35 U.S.C. 154(b) by 364 days.

(21) Appl. No.: 11/466,210

(22) Filed: Aug. 22, 2006

(65) Prior Publication Data

US 2007/0060009 A1 Mar. 15, 2007

(30) Foreign Application Priority Data

Sep. 9, 2005 (KR) ..... 10-2005-0084244
Oct. 18, 2005 (KR) ..... 10-2005-0098059

(51) Int. Cl.
*H01J 9/46* (2006.01)
*H01J 9/38* (2006.01)

(52) U.S. Cl. ..... 445/66; 445/70; 445/73; 118/408; 118/423

(58) Field of Classification Search ..... 445/60–73; 118/408, 423
See application file for complete search history.

(56) References Cited

U.S. PATENT DOCUMENTS 2,287,024 A * 6/1942 Casellini ..... 118/58
2,303,290 A * 11/1942 Michael ..... 118/50
2,318,060 A * 5/1943 Cortese ..... 427/67
2,349,444 A * 5/1944 McGowan ..... 118/408
3,850,136 A * 11/1974 Ruzzo ..... 118/50
7,455,733 B2 * 11/2008 Lee et al. ..... 118/50

* cited by examiner

*Primary Examiner*—Mariceli Santiago
(74) *Attorney, Agent, or Firm*—Barnes & Thornburg LLP

(57) ABSTRACT

A cassette assembly and a method of manufacturing fluorescent lamps using the cassette assembly are provided. The cassette assembly includes a housing defining a process chamber and having a plurality of holes in which glass tubes for the fluorescent lamps are inserted to communicate with the chamber, a carrying unit including two or more porous plates through which the glass tubes are fitted, a plurality of ring members disposed on the porous plates to preliminarily fix the glass tubes to the carrying unit by allowing the outer circumferences of the glass tubes to contact, and a locking unit for changing the glass tubes from the preliminary fixing status to a lockup status by varying contact pressure applied between the ring members and the glass tubes.

11 Claims, 12 Drawing Sheets

CASSETTE ASSEMBLY FOR MANUFACTURING FLUORESCENT LAMPS

CLAIM OF PRIORITY

This application makes reference to, incorporates the same herein, and claims all benefits accruing under 35 U.S.C. §119 from applications earlier filed in the Korean Intellectual Property Office on 9 Sep. 2005 and 18 Oct. 2005 and there, duly assigned Serial Nos. 10-2005-0084244 and 10-2005-0098059, respectively.

BACKGROUND OF THE INVENTION

1. Field of the Invention

This invention relates to a cassette assembly for manufacturing fluorescent lamps, which can effectively carry and handle a plurality of glass tubes for the fluorescent lamps, and more particularly, to a cassette assembly for manufacturing fluorescent lamps, which can allow inner walls of a plurality of glass tube for fluorescent lamps to be simultaneously coated, thereby improving the productivity.

2. Description of the Related Art

Generally, a fluorescent lamp is produced by coating fluorescent substance exciting ultraviolet rays on the inside wall of a thin long glass tube, injecting light emitting gas and mercury in the glass tube, and sealing the glass tube. According to the position of electrode installed at opposite ends of the glass tube, the fluorescent lamps are classified into a cold cathode fluorescent lamp (CCFL) and an external electrode fluorescent lamp (EEFL). The EEFL has better light quality, longer lifetime, and less electric consumption as compared with the CCFL. Also, the EEFL can be produced to a compact size. Therefore, the EEFL has been widely used as a backlight of a liquid crystal display (LCD).

A typical method of manufacturing the EEFL includes a process of coating fluorescent substance the inside wall of the glass tube, a process of calcinating the coated fluorescent substance, a process of injecting light emitting gas and mercury into the glass tube, a process of sealing opposite ends of the glass tube, and a process of forming electrodes on the opposite ends of the glass tube.

Among the processes described above, the coating process and the injecting process are conventionally conducted with 3-5 glass tubes inserted in holes formed along a circumferential edge of a disc-shaped stage rotating horizontally.

However, in the conventional method of manufacturing the fluorescent lamp, since the coating, injecting and sealing processes are performed in a state where the small number of glass tubes are loaded to the size limited disc-shaped stage, it is difficult to improve the productivity.

In addition, since each glass tube has to be connected or disconnected one by one to a chamber in every process of the manufacturing procedure, the manufacturing process is complicated and consequently time-consuming.

Obviously, when the glass tubes are individually loaded on the stage or connected to a chamber, it is difficult to handle a lot of glass tubes during the manufacturing process, and therefore the working efficiency and the productivity are further deteriorated.

SUMMARY OF THE INVENTION

The present invention has been made in an effort to solve the above-described problems of the prior art.

It is an object of the present invention to provide a cassette assembly, by which a plurality of glass tubes for fluorescent lamps can be loaded and processed simultaneously, thereby improving the productivity.

In one exemplary embodiment of the present invention, A cassette assembly includes a housing defining a process chamber and having a plurality of holes in which glass tubes for the fluorescent lamps are inserted to communicate with the chamber, a carrying unit including two or more porous plates through which the glass tubes are fitted, a plurality of ring members disposed on the porous plates to preliminarily fix the glass tubes to the carrying unit by allowing the outer circumferences of the glass tubes to contact, and a locking unit for changing the glass tubes from the preliminary fixing status to a lockup status by varying contact pressure applied between the ring members and the glass tubes.

In another exemplary embodiment of the present invention, a method of manufacturing fluorescent lamps includes loading a plurality of glass tubes on porous plates; washing and wetting the glass tubes; coating the glass tubes with fluorescent substance simultaneously; brushing the glass tubes coated with the fluorescent substance; unloading the glass tubes from the porous plates; baking the unloaded glass tubes; sealing the baked glass tubes; forming electrodes on the sealed glass tubes; and aging the glass tubes.

BRIEF DESCRIPTION OF THE DRAWINGS

A more complete appreciation of the present invention and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF PREFERRED EMBODIMENTS

Reference will now be made in detail to the preferred embodiments of the present invention, examples of which are illustrated in the accompanying drawings. The invention may, however, be embodied in may different forms and should not be construed as being limited to the embodiments set forth herein; rather, these embodiments are provided so that this disclosure will be through and complete, and will fully convey the concept of the invention to those skilled in the art. Throughout the drawings, like reference symbols indicate the same or similar components.

Figure 1:
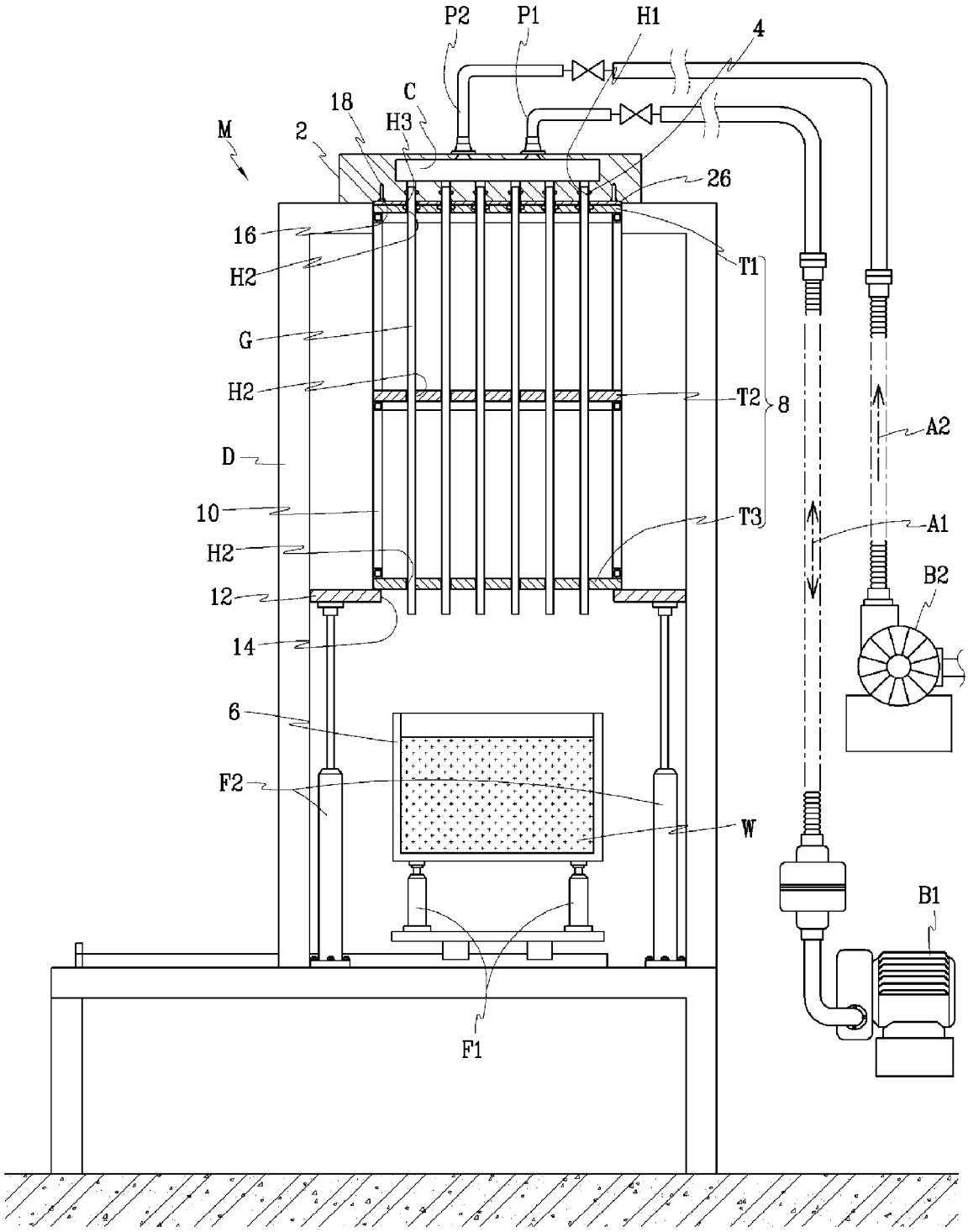
FIG. 1 illustrates a fluorescent lamp manufacturing apparatus to which a cassette assembly according to an embodiment of the present invention is applied.

FIG. 1 is illustrates an overall structure of a cassette assembly according to an embodiment of the present invention.

Referring to FIG. 1, the symbol M is a coating unit for conducting a process of coating fluorescent substance. The coating unit includes a chamber C.

A chamber C is defined in a box-shaped housing 2, and a plurality of holes H1 are bored on the bottom of a housing 2 to detachably couple the upper ends of a plurality of glass tubes G to a chamber C.

A plurality of ring members 4 are installed inside of the holes H1 respectively to ensure a gas tight connection between the upper ends of glass tubes G and a chamber C.

As shown in FIG. 1, the housing 2 is disposed on a workbench D horizontally, and a container 6 containing the fluorescent substance W that will be coated on the inside wall of the glass tubes G is placed on the bottom of the workbench D. The container 6 is designed to vertically move by a cylinder F1 to immerse the lower ends of the glass tubes G into the fluorescent substance W stored in the container 6.

A variety of units such as a vacuum pump for supplying drying air A2 and a blower B2 for supplying negative pressure A1 are connected to the chamber C to coat the fluorescent substance W on the inside walls of the glass tubes G.

Figure 2:
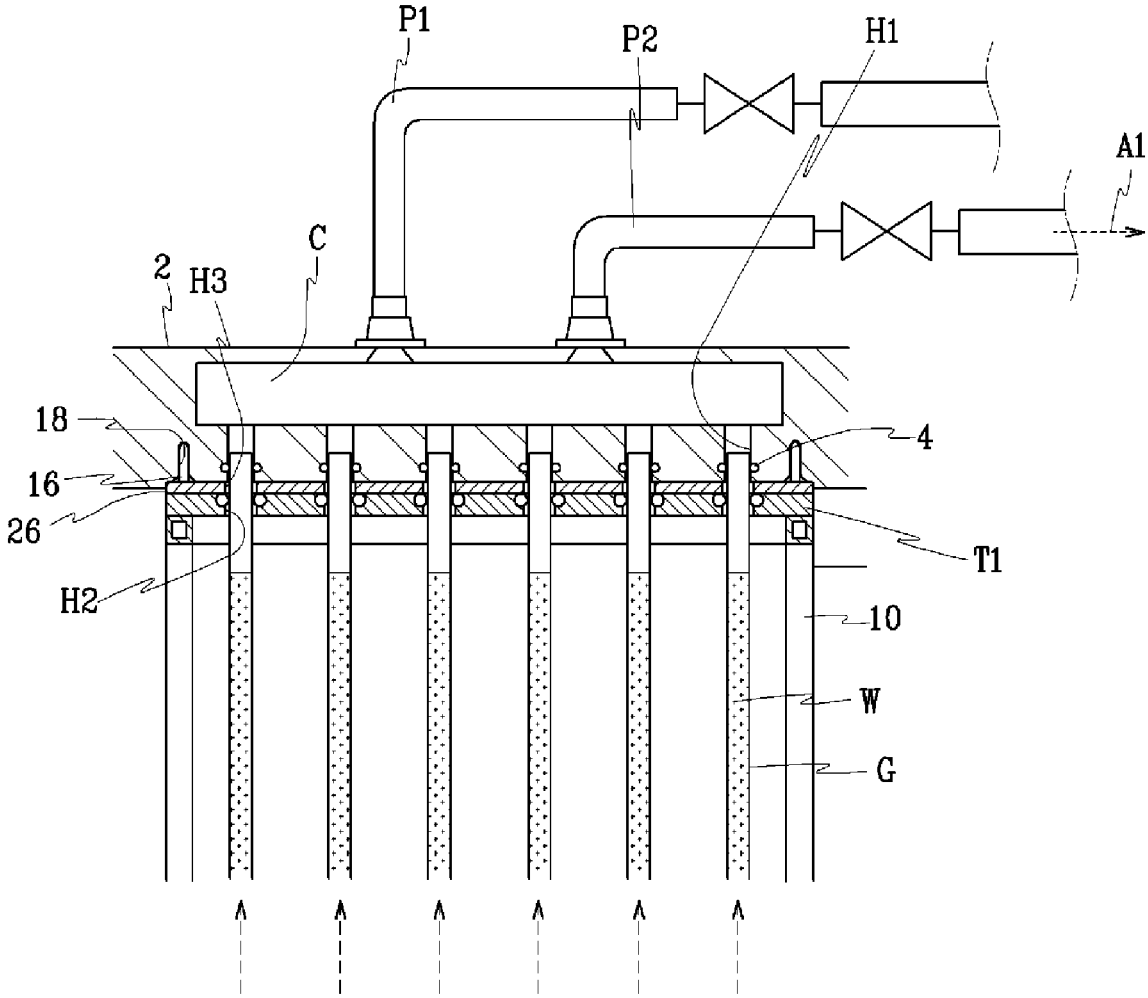
FIGS. 2 and 3 illustrate a process for coating fluorescent substance using a coating unit depicted in FIG. 1.
Figure 3:
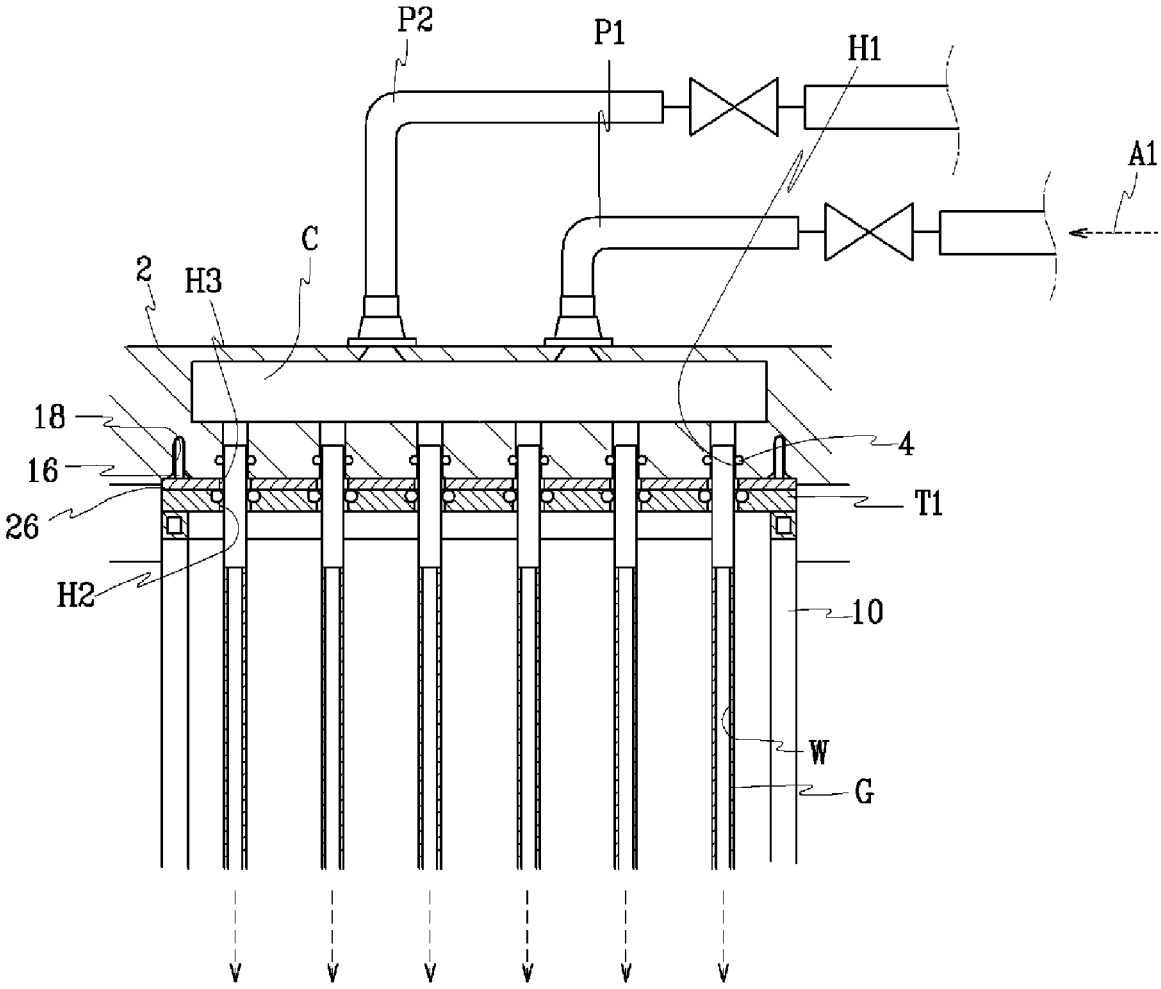
Figure 4:
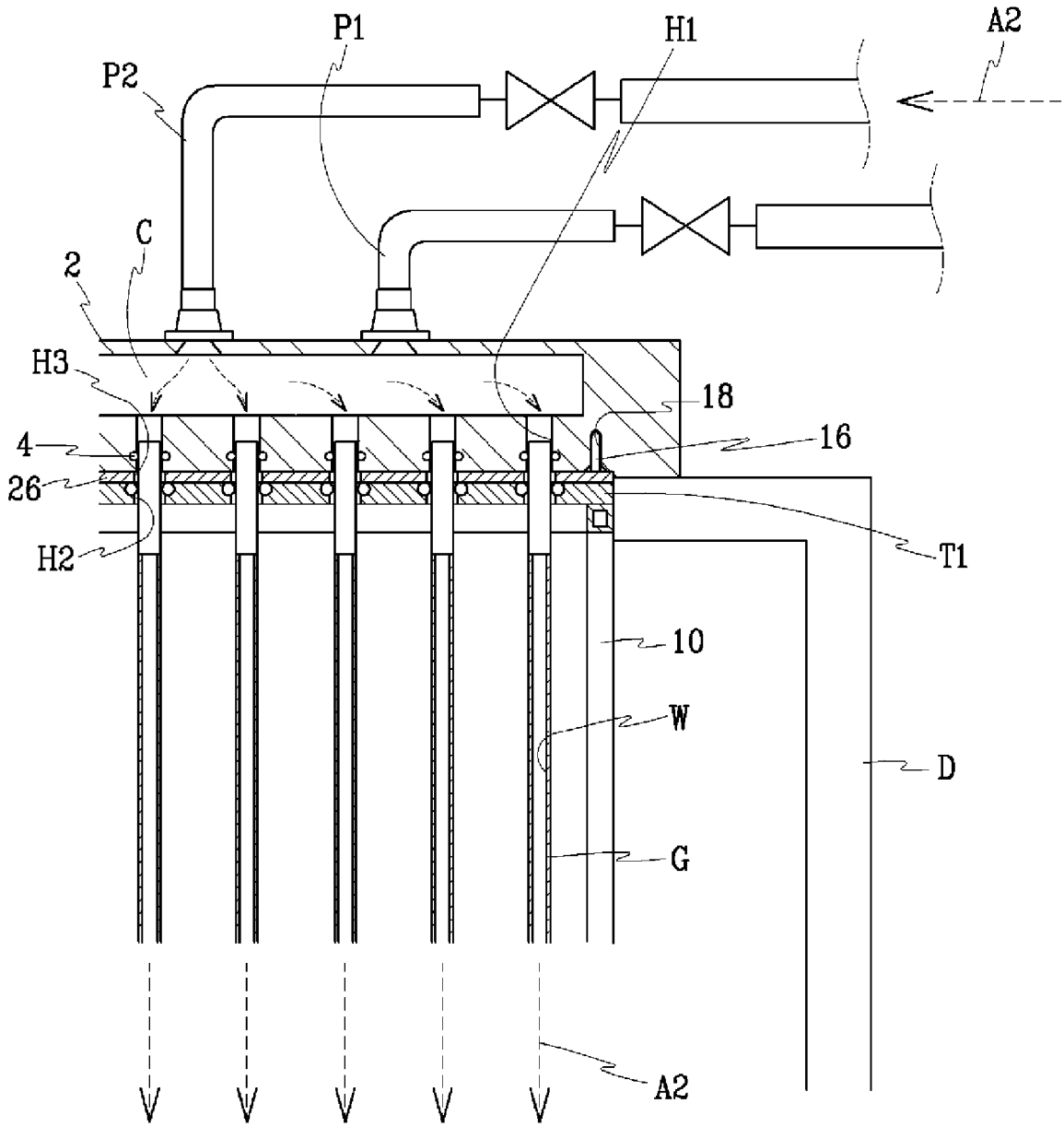
FIG. 4 illustrates a process for drying the fluorescent substance using the coating unit depicted in FIG. 1.

The vacuum pump B1 is connected to a port P1 formed on the housing 2 to make the internal pressure of the glass tubes be equal to or less than the atmospheric pressure. When the negative pressure A1 is generated by the vacuum pump B1, the fluorescent substance W is sucked into the glass tubes G as shown in FIG. 2. When the negative pressure is released, the sucked fluorescent substance W flows down in the glass tubes Gas shown in FIG. 3. Accordingly, the fluorescent substance W is coated on the inside walls of the glass tubes G.

The blower B2 is connected to a port P2 formed on the housing to supply air heated up to about 150° C. into the chamber C, thereby drying the coated fluorescent substance W. The air can be heated by a separate heating unit.

Figure 5:
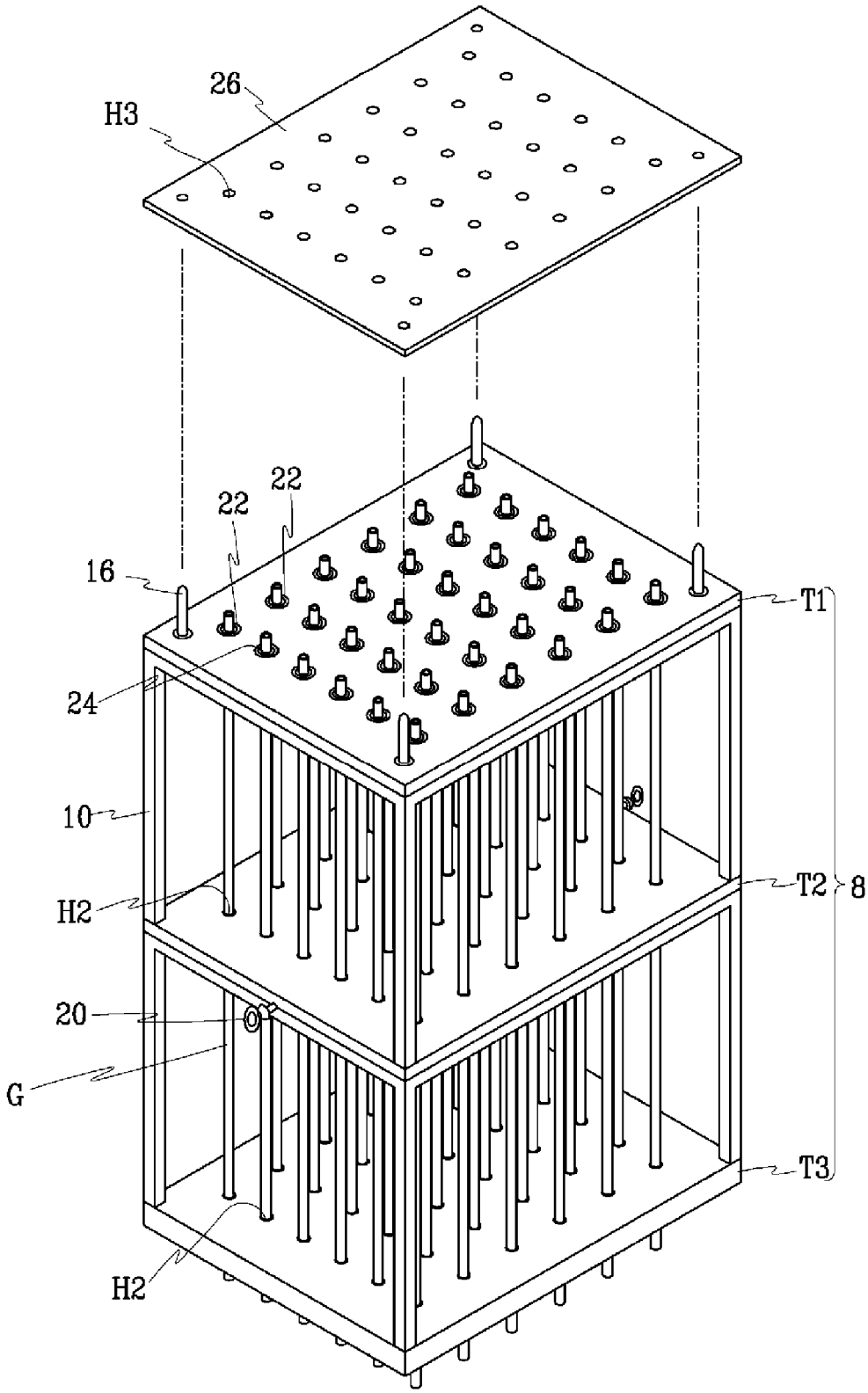
FIG. 5 illustrates the cassette assembly depicted in FIG. 1.

The glass tubes are detachably coupled with a chamber C with maintaining loaded status on a carrying unit 8. The carrying unit 8 includes more than two supporting plates. Referring to FIG. 5, the carrying unit 8 includes three porous plates porous plate T1, T2, and T3 that are spaced apart from each other in the vertical direction and face each other horizontally. The plate T1, T2 and T3 are fixed on a frame 10.

The frame 10 functioning to securely fix the porous plates porous plate T1, T2, T3 may be formed by connecting pipes or bars that may be formed of light metal or synthetic resin that is robust and corrosion-resistant.

The porous plates T1, T2 and T3 are provided with a plurality of fixing holes H2 through which the glass tubes G are inserted and fixed.

Each of the holes H2 has a diameter the glass tube G can pass. The holes H2 have same arrangement as the holes H1 of the chamber C.

The material for the porous plates T1, T2 and T3 is selected from synthetic resins having predetermined mechanical strength, heat-resistance and corrosion-resistances and not scratching the glass tubes G.

The carrying unit 8 is loaded on a lift 12 installed inside of the workbench D and, is detachably mounted on the bottom of the housing 2 while vertically moving by the lift 12.

The lift 12 may be formed of a metal plate provided at a central portion with an opening 14 smaller than the lowest porous plate porous plate T3 so that the lower ends of the glass tubes G can be penetrated through the opening 14 when the carrying unit 8 is loaded on the lift 12.

A plurality of cylinders F2 installed on the bottom of the workbench D can be used as a drive source for drying the lift 12, and piston rods of the cylinders F2 move vertically the lift 12 with maintaining horizontal position so that the upper ends of the glass tubes G can be detachably connected to the chamber C.

The cassette assembly according to the present invention includes a guide unit for guiding a connection position of the glass tubes G to the chamber C.

Figure 6:
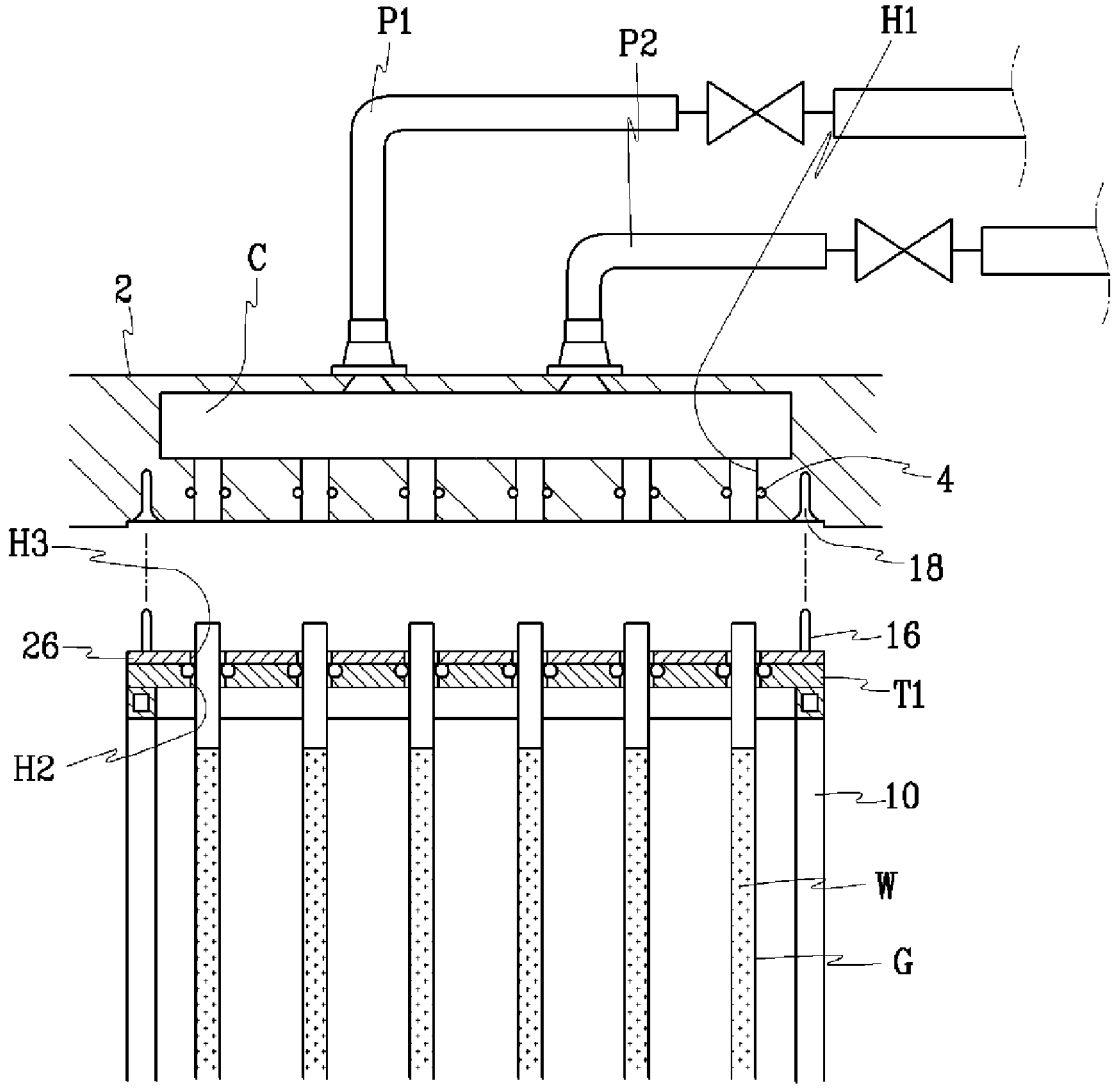
FIG. 6 illustrates a guide unit of the cassette assembly depicted in FIG. 5.

According to this embodiment, as shown in FIG. 6, more than two guide projections 16 are installed on the top porous plate porous plate T1, and guide grooves 18 in which the guide projections 16 are inserted are formed on the bottom of the housing 2 to guide the docking positions of the glass tubes G on the housing 2.

The guide projections 16 is installed upright on the top porous plate T1 in the carrying unit 8 and can be positioned at more than two different places. The guide grooves 18 are formed at the bottom of the housing 2 to correspond to the positions of the guide projections 16 with enough opening size to accept the guide projection therein.

Also, the guide projections 16 protrude to be longer than the upper ends of the glass tubes G in the upward direction.

The guide projections 16 may be pin member formed of metal such as SUS. The guide projections 16 may be detachably and integrally fixed on the top porous plate porous plate T1 in the carrying unit 8.

The edges of openings of the guide grooves 18 are cut to be rounded or inclined for the easy insertion of the guide projections 16.

A hook member 20 such as eyebolt is installed on more than two places of the frame 10 of the carrying unit 8. Jigs (not shown) that can be hooked on the hook members 20 are installed on a robot arm (not shown) so that the glass tubes G can be conveyed easily with maintaining desired positions in a process region in which the fluorescent lamp can be manufactured.

A plurality of ring members 22 are installed on the carrying unit 8 to preliminarily fix the glass tubes G using contact pressure.

As shown in FIG. 5, the ring members 22 are located in the holes H2 of the top porous plate porous plate T1 in the carrying unit 8.

The multiple ring members 22 can be made of rubber or silicon material that has elastic property and frictional force. The multiple ring members 22 are fixedly fitted on stepped seat portions 24 formed at the top edges of holes H2. Inner diameters of the ring members 22 are large enough for the glass tubes G to be forcedly fitted through the ring members 22. When glass tube G is fitted through the ring member 22, the ring member applies predetermined contact pressure to the outer circumference of the glass tube G. The diameter of the stepped seat portion 24 is identical to the outer diameter of the ring member 22. When the ring members 22 are installed on the stepped seat portions 24, the ring members 22 protrude above the top surface of the top porous plate T1.

The ring members 22 fix preliminarily the glass tubes G penetrating the holes H2 of the porous plates porous plate T1, T2 and T3 in the carrying unit 8 as the outer circumference of the glass tubes G contacts the inner circumference of the ring members 22.

The preliminary fixing status prevents the glass tubes G from slipping down when the glass tubes G are inserted through the holes H2 of the porous plates porous plate T1, T2 and T3. Also, in the preliminary fixing status, it is preferable that the glass tubes G can be separated from the porous plates porous plate T1, T2 and T3 only when outer force higher than a predetermined level is applied to the glass tubes G.

A locking unit is installed in the cassette assembly to switch the glass tubes G loaded in the carrying unit 8 from the preliminary fixing status to a complete lockup status.

Figure 7:
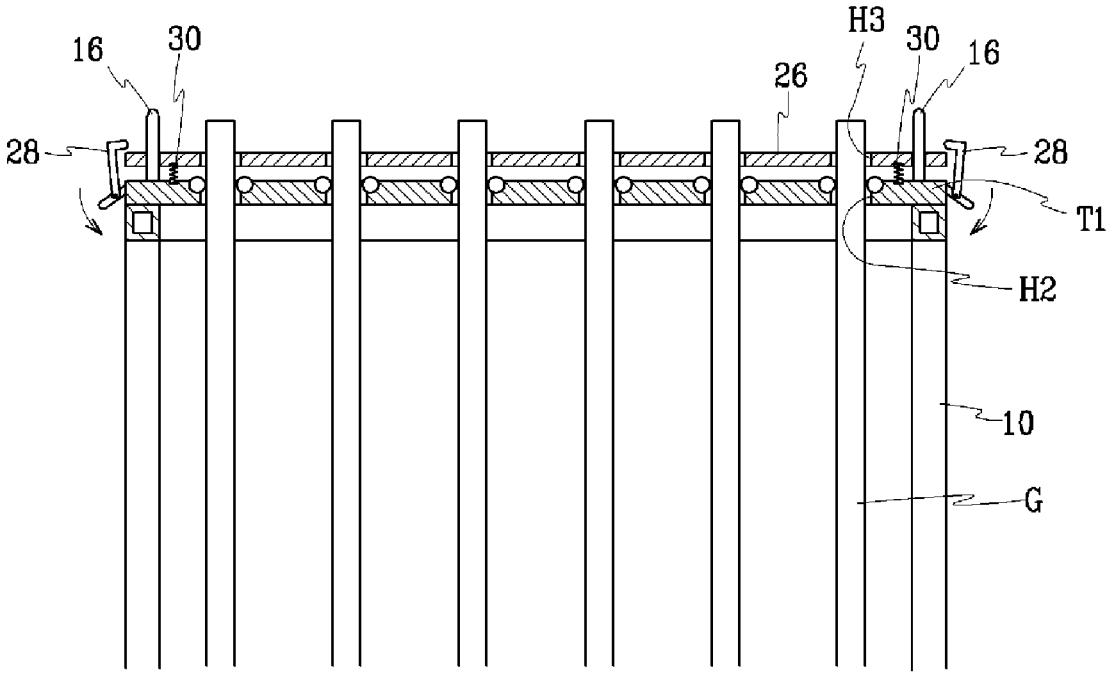
FIG. 7 illustrates a locking unit of the cassette assembly depicted in FIG. 5.

In this embodiment, as shown in FIG. 7, a pressing plate 26 is used as the locking unit. The pressing plate 26 is disposed to face the top porous plate T1 with the ring members 22 interposed therebetween. When the pressing plate 26 is operated to move toward or away from the top porous plate T1, the ring members 22 is pressed down to be changed into the complete lockup status.

The size of the pressing plate 26 is almost same as that of the top porous plate T1. The, and, for the glass tubes G to penetrate through, holes H3 corresponding to the holes H2 of the top porous plate T1 are formed on the pressing plate 26.

The pressing plate 26 is vertically guided by the guide projections 16 formed on the top porous plate T1 in a state where it is fitted around the guide projections 16. For the material of the pressing plate 26, it is desirable to utilize metal or synthetic resin for the pressing plate 26 not to be bent or deformed during the pressing process.

The pressing plate 26 presses down the ring members 22 by clamping action. That is, as shown in FIG. 7, more than two clamping members 28 are installed on the top porous plate T1 so that the clamping members 28 presses down the ring members 22 while approaching horizontally toward the top porous plate porous plate T1.

The clamping members 28 may be formed in a typical hook structure having a fixing end rotatably fixed at the top porous plate T1 and a free end detachably hooked to the pressing plate 26 to that the clamping can be realized by force applied downward. However, the clamping members 28 are not limited to this typical hook structure. Any structures can be utilized as long as it can be move the pressing plate 26 toward the top porous plate T1 by the clamping action.

Elastic members 30 such as compressing coil springs can be placed between the pressing plate 26 and the top porous plate T1. These elastic members 30 enable the pressing plate 26 to return opposite direction when clamping action is released after pressing.

Figure 8:
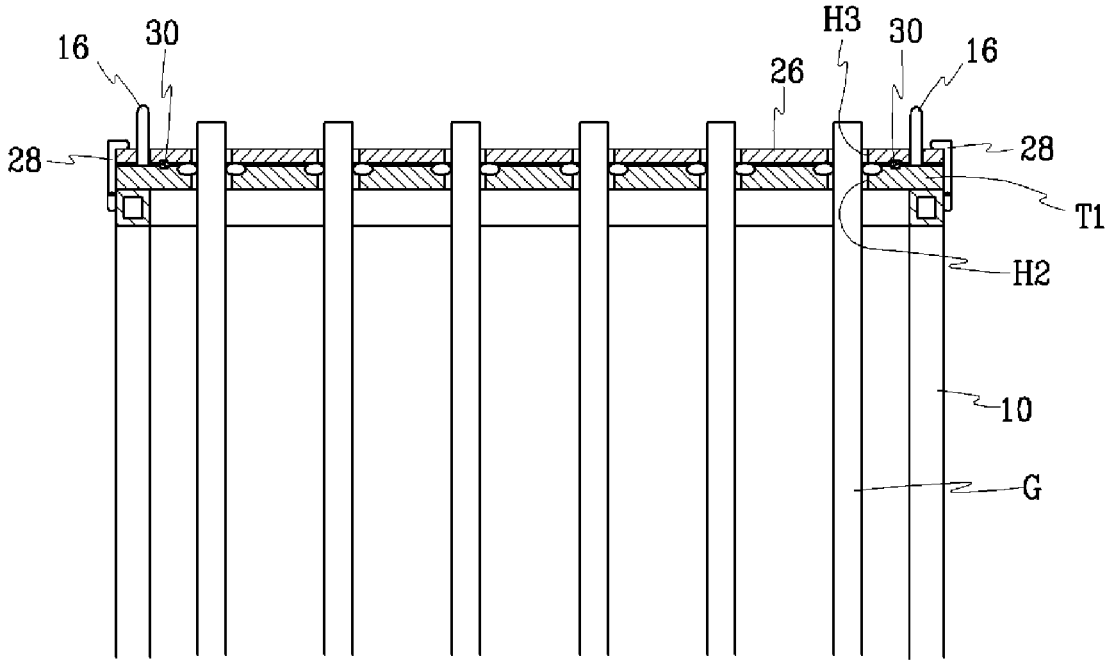
FIGS. 8 and 9 illustrate an operation of the locking unit depicted in FIG. 7.
Figure 9:
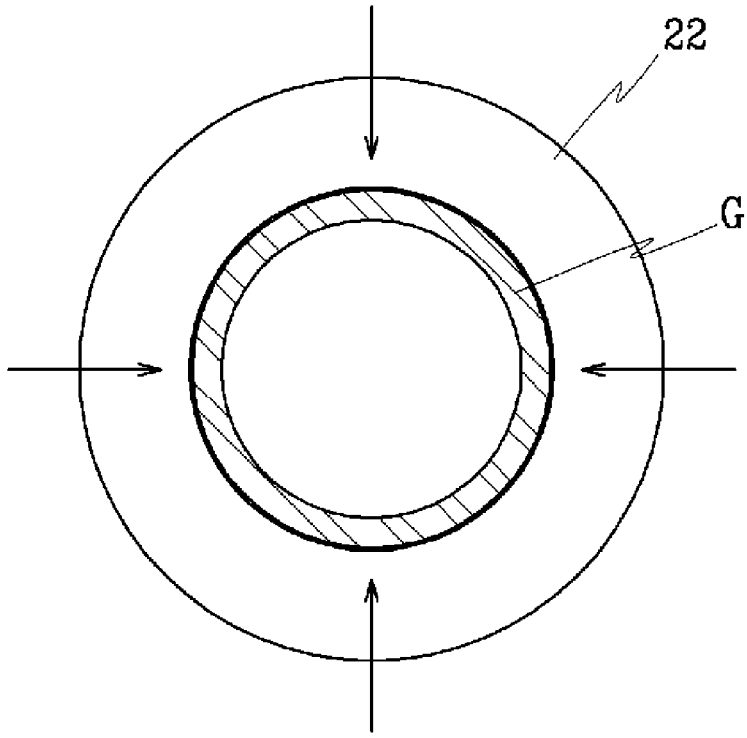

The locking unit changes the status of the glass tubes G from the preliminary fixing status to the lockup state by moving the pressing plate 26 toward the top porous plate T1 as shown in FIG. 8. The ring members 22 pressed down by the pressing plate 26 are deformed to reduce the inner diameter thereof and thus contact pressure between the ring members 22 and the outer circumferences of the glass tubes G increases. Therefore, the deformed ring members 22 enable to lock up the glass tubes G.

The lockup status prevents the glass tubes G loaded in the carrying unit 8 from changing their positions or slipping down when the carrying unit 8 is conveyed together with the glass tubes G.

Figure 10:
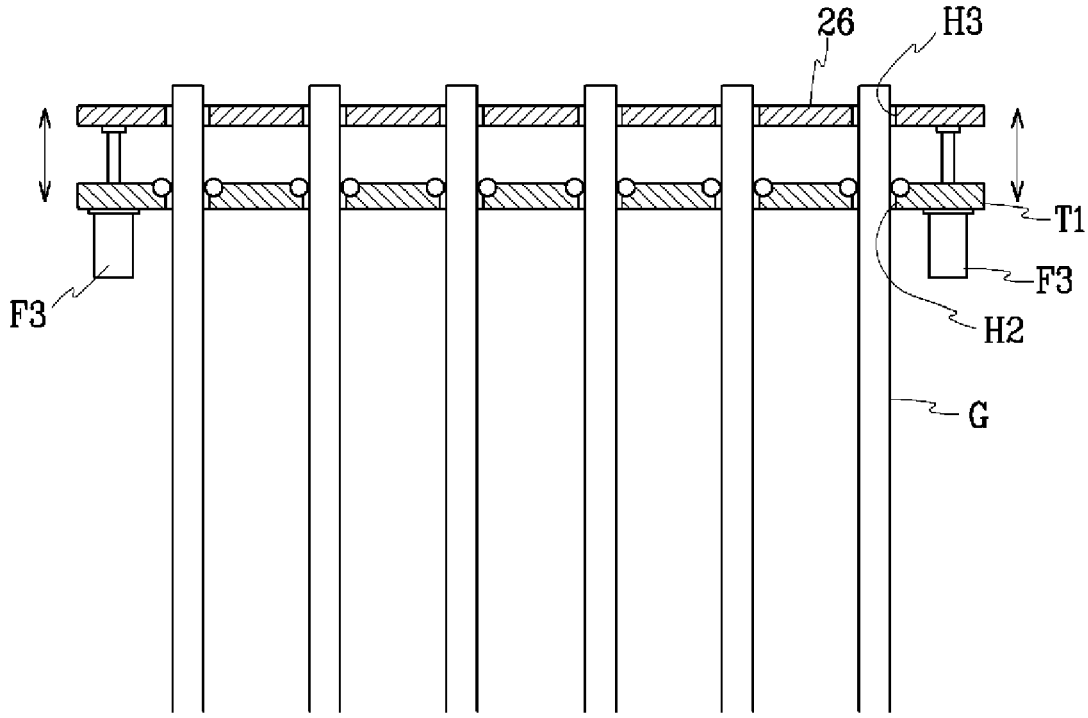
FIGS. 10 and 11 illustrate a variety of modified examples of the locking unit.
Figure 11:
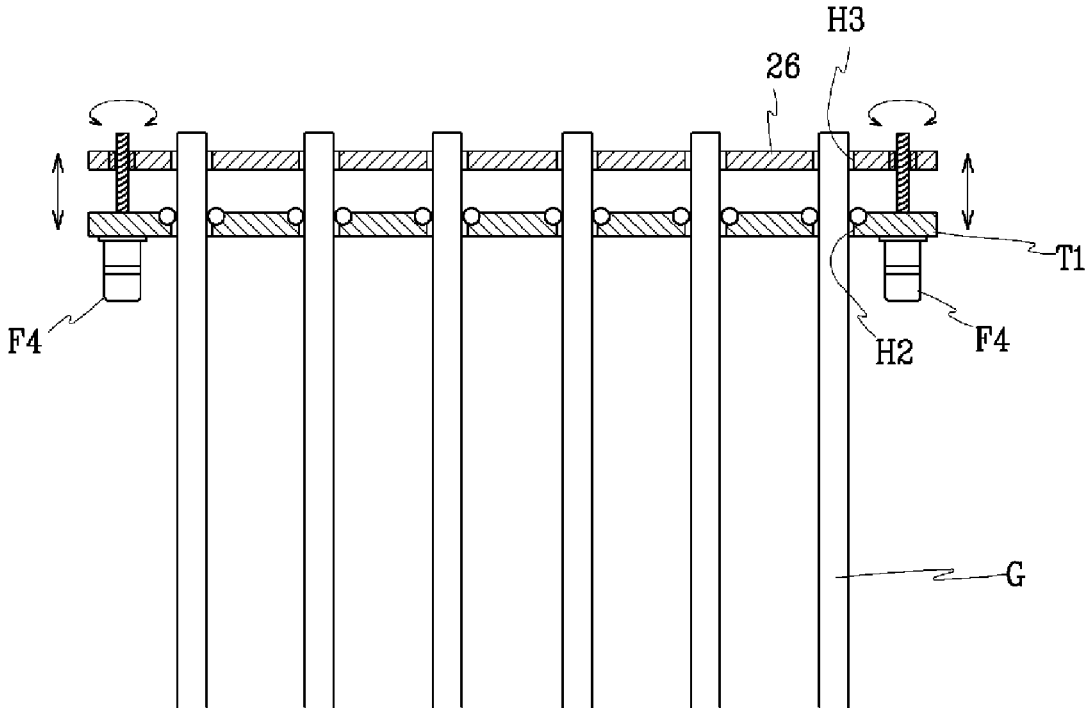

In this embodiment, the pressing plate 26 is passively operated by the clamping members 28. However, the present invention is not limited to this case. For example, as shown in FIG. 10, the pressing plate 26 can be coupled to the piston rods of the cylinders F3. Alternatively, as shown in FIG. 11, the locking unit can be installed with penetrating screws coupled with a shaft of a driving motor F4 so that the pressing plate 26 can be pressed down by the linear or rotating motion of the screws.

The locking unit can be installed in response to one or more of the porous plates T1, T2 and T3 in the carrying unit 8 when the ring members 22 are located on porous plates T1, T2 and.

A method of manufacturing the fluorescent lamp using the above-described cassette assembly will be described hereinafter.

Figure 12:
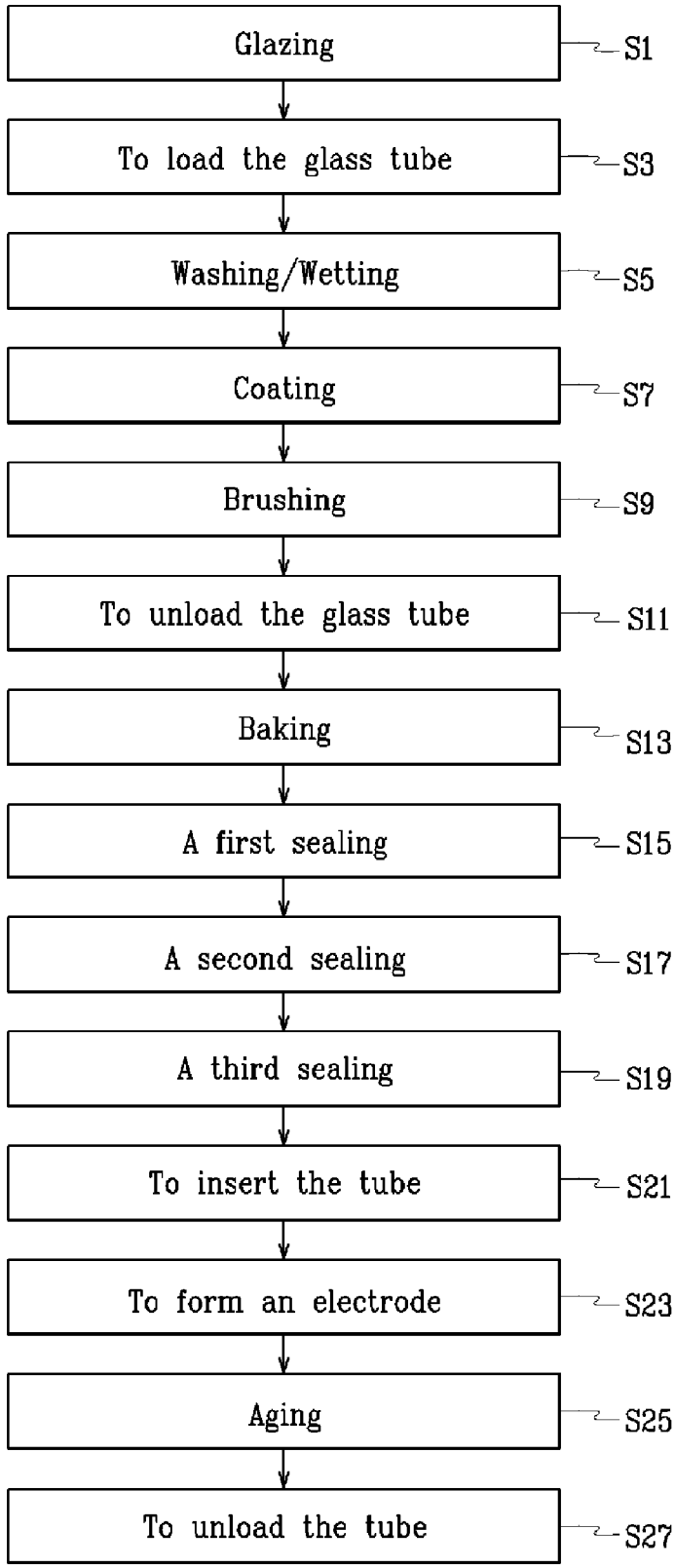
FIG. 12 is a flowchart illustrating a method of manufacturing fluorescent lamps according to an embodiment of the present invention.

Referring to FIG. 12, the glass tubes G are glazed (S1) to make the ends of the glass tubes G rounded by heating the ends of the glass tube G using a torch. The glazing is a fundamental process for manufacturing high quality lamps.

Then, the glass tubes G are loaded on the carrying unit 8 (S3). As described above, the porous plates are utilized for setting the glass tubes G, and the glass tubes G are locked up by the pressing plate 26.

When the glass tubes G are locked up, the manufacturing method is followed by washing, wetting, coating, and brushing processes. At each process, the glass tubes G are performed simultaneously.

That is, the washing and wetting processes for the insides of the glass tubes are performed in a state of the glass tubes G are locked up (S5). The wetting of the glass tubes G is for keeping uniform humidity or dryness after washing them to produce uniform quality of the products.

After the glass tubes G are washed, the glass tubes G are coated with fluorescent substance W stored in the container 6 by generating negative pressure in the glass tubes G, followed by passing hot air through the glass tubes G to dry the coated fluorescent substance S7.

After the above, the brushing process is conducted to remove the coated fluorescent substance from the ends of the glass tubes S9. In the brushing process, the glass tubes maintain their lockup status on the porous plates.

Then, the glass tubes G are unloaded S11 from the carrying unit 8 and a baking process is conducted to securely fix the fluorescent substance on the inside walls of the glass tubes.

Next, a forming process for forming the glass tubes is followed and a first sealing process for sealing a first end of each glass tube is conducted (S15). The first sealing process is conducted by melting the first end of the glass tube using a torch.

After the first end of each glass tube G is sealed, the inside of each glass tube is exhausted. Then, discharging gas such as argon or neon is injected into the glass tubes, after which a second sealing process is performed (S17). After then, the glass tubes are heated to generate mercury vapor, after which a third sealing process is performed (S19).

Then, the glass tubes G are loaded again on the porous plates and electrodes are installed on opposite ends of each glass tube (S23), after which an aging process is performed (S25). The aging process is for stabilizing the glass tubes G by generating initial discharge. In this aging process, the plurality of glass tubes are simultaneously processed.

After the aging process is finished, the glass tubes are unloaded from the porous plates (S27).

According to the present invention, the glass tubes can be simultaneously conveyed easily to the chamber in which the processes are performed in a state where the glass tubes are loaded in the carrying unit. The elastic ring members enable to prevent the glass tubes from slipping down or changing their positions during conveying multiple glass tubes. Therefore, this invention improves the working efficiency and productivity of the fluorescent lamps.

In addition, since many fluorescent lamps are simultaneously manufacture using the porous plates and thus this invention provides an advantage of manufacturing large volume of fluorescent lamps.

Although exemplary embodiments of the present invention have been described in detail hereinabove, it should be clearly understood that many variations and/or modifications of the basic inventive concept taught herein still fall within the spirit and scope of the present invention, as defined by the appended claims.

What is claimed is:

1. A cassette assembly for manufacturing multiple fluorescent lamps, comprising:

a housing defining a process chamber and having a plurality of holes in which glass tubes for the fluorescent lamps are inserted to communicate with the chamber, the holes being formed through a bottom of the housing to correspond to the glass tubes;

a carrying unit including two or more porous plates through which the glass tubes are fitted;

a plurality of ring members disposed on the porous plates to preliminarily fix the glass tubes to the carrying unit by allowing the outer circumferences of the glass tubes to contact; and a locking unit for changing the glass tubes from the preliminary fixing status to a lockup status by varying contact pressure applied between the ring members and the glass tubes.

2. The cassette assembly of claim 1, further comprising a guide unit for guiding docking positions of the tubes between the housing and the carrying unit.

3. The cassette assembly of claim 1, wherein the porous plates are horizontally disposed and spaced apart from each other in a vertical direction, each of the porous plate being provided with a plurality of fixing holes in which the glass tubes are fitted.

4. The cassette assembly of claim 1, wherein the ring members are installed on the holes of the porous plates in the carrying unit, the ring members respectively correspond to the glass tubes such that outer circumferences of the glass tubes contact inner circumferences of the ring members

5. The cassette assembly of claim 1, wherein the ring members is formed of a synthetic rubber material so that the ring members maintain the preliminary fixing stats of the glass tubes to prevent the glass tubes from slipping down, when the glass tubes are inserted in ring members.

6. The cassette assembly of claim 2, wherein the guide unit includes projections and corresponding grooves that are detachably interlocked with each other between the carrying unit and the housing.

7. The cassette assembly of claim 1, wherein the locking unit includes a pressing plate facing the porous plate with the ring members disposed therebetween, the pressing plate pressing down the ring member such that an inner diameter of the ring member is reduced or increased.

8. The cassette assembly of claim 7, wherein the pressing plate can be moved toward or away from the porous plate by receiving driving force from a driving source such as a clamping member, a cylinder, or a motor.

9. The cassette assembly of claim 1, further comprising a hook portion to operate the carrying unit in a hooked status, wherein the hook portion are formed on more than two different locations of the carrying unit.

10. A cassette assembly for manufacturing multiple fluorescent lamps, comprising:

a housing defining a process chamber and having a plurality of holes in which glass tubes for the fluorescent lamps are inserted to communicate with the chamber;

a carrying unit including two or more porous plates through which the glass tubes are fitted;

a guide unit for guiding docking positions of the tubes between the housing and the carrying unit;

a plurality of ring members disposed on the porous plates to preliminarily fix the glass tubes to the carrying unit by allowing the outer circumferences of the glass tubes to contact; and a locking unit for changing the glass tubes from the preliminary fixing status to a lockup status by varying contact pressure applied between the ring members and the glass tubes.

11. A cassette assembly for manufacturing multiple fluorescent lamps, comprising:

a housing defining a process chamber and having a plurality of holes in which glass tubes for the fluorescent lamps are inserted to communicate with the chamber;

a carrying unit including two or more porous plates through which the glass tubes are fitted;

a plurality of ring members disposed on the porous plates to preliminarily fix the glass tubes to the carrying unit by allowing the outer circumferences of the glass tubes to contact; and a locking unit for changing the glass tubes from the preliminary fixing status to a lockup status by varying contact pressure applied between the ring members and the glass tubes, the locking unit including a pressing plate facing the porous plate with the ring members disposed therebetween, the pressing plate pressing down the ring member such that an inner diameter of the ring member is reduced or increased.

* * * * *